US009167925B2

(12) United States Patent
Rafnson et al.

(10) Patent No.: US 9,167,925 B2
(45) Date of Patent: Oct. 27, 2015

(54) PLATE COVER ASSEMBLY

(71) Applicants: Philip Rafnson, Bloomington, MN (US); Carol Lozinski, San Diego, CA (US)

(72) Inventors: Philip Rafnson, Bloomington, MN (US); Carol Lozinski, San Diego, CA (US)

( * ) Notice: Subject to any disclaimer, the term of this patent is extended or adjusted under 35 U.S.C. 154(b) by 0 days.

(21) Appl. No.: 13/705,696

(22) Filed: Dec. 5, 2012

(65) Prior Publication Data

US 2013/0341340 A1 Dec. 26, 2013

Related U.S. Application Data

(60) Provisional application No. 61/567,260, filed on Dec. 6, 2011.

(51) Int. Cl.

| | |
|---|---|
| ***A47G 19/08*** | (2006.01) |
| ***A47G 19/02*** | (2006.01) |
| ***B65D 25/36*** | (2006.01) |

(52) U.S. Cl.

CPC ..... *A47G 19/02* (2013.01); *A47G 19/025* (2013.01); *B65D 25/36* (2013.01)

(58) Field of Classification Search

USPC ..... 220/574.3, 573, 574, 730, 732, 737, 220/4.22, 4.23, 4.24, 912, 632, 648, 694, 220/741, 23.91, 642, 643, 768, 655, 729, 220/574.2, 574.1, 640, 4.21, 769, 756, 758, 220/23.2, 23.4, 23.8; D7/396.5; 40/779, 40/798, 799; 206/453, 303; 446/77, 485, 446/122, 124; 362/253, 101

See application file for complete search history.

(56) References Cited

U.S. PATENT DOCUMENTS

| | | | | |
|---|---|---|---|---|
| 1,829,861 | A | 11/1931 | Holt | |
| 3,242,605 | A * | 3/1966 | Kleinschmidt | 40/705 |
| 3,680,733 | A * | 8/1972 | Winslow | 220/642 |
| 4,848,543 | A * | 7/1989 | Doboze | 206/551 |
| D341,518 | S | 11/1993 | Richardson | |
| 6,464,222 | B1 | 10/2002 | Parker | |
| 7,093,832 | B2 | 8/2006 | Parker | |
| D531,558 | S * | 11/2006 | Peng | D12/193 |
| 7,163,311 | B2 | 1/2007 | Kamer | |
| 2002/0079317 | A1 | 6/2002 | Scott | |
| 2009/0126248 | A1 * | 5/2009 | Burnstein | 40/799 |
| 2009/0291273 | A1 | 11/2009 | Canales | |
| 2010/0154267 | A1 * | 6/2010 | Nip | 40/799 |

* cited by examiner

*Primary Examiner* — Jeffrey Allen
*Assistant Examiner* — Jennifer Castriotta
(74) *Attorney, Agent, or Firm* — Dicke, Billig & Czaja, PLLC

(57) ABSTRACT

A plate cover assembly includes at least one portion that is removably securable onto a plate. For example, one cover includes a first covering portion and a second covering portion which are positionable to enclose an outer portion of a plate. Upon removably securing the respective first and second covering portions together, the plate cover assembly encloses the border of the plate while leaving a central region of the plate exposed.

15 Claims, 8 Drawing Sheets

PLATE COVER ASSEMBLY

CROSS-REFERENCE TO RELATED APPLICATIONS

This Utility patent application is a Non Provisional application of U.S. Provisional Application Ser. No. 61/567,260, filed Dec. 6, 2011, which is incorporated herein by reference.

BACKGROUND

Dinner plates come in a wide variety of styles, shapes, and sizes. Plate manufacturers spend a great deal of time and energy in developing styles to appeal to their customers. Given the relatively large price for obtaining a set of dinner plates, most consumers own just one or two sets of plates.

DETAILED DESCRIPTION

In the following Detailed Description, reference is made to the accompanying drawings which form a part hereof, and in which is shown by way of illustration specific embodiments of the present disclosure which may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense.

Examples of the present disclosure are directed to a removably attachable cover assembly for a dinner plate. In one example, the cover includes a first covering portion and a second covering portion which are positionable to enclose an outer portion (e.g. border) of a plate. Upon removably securing the respective first and second covering portions together, the plate cover assembly encloses the border of the plate while leaving a central region of the plate exposed. In some examples, the upper portion of the plate cover assembly includes an array of decorative elements or other information. In one example, the plate cover assembly has a generally annular configuration for covering a generally circular plate. However, a plate cover assembly of the present disclosure can take a wide variety of shapes, such as rectangular, triangular, polygon, elliptical, etc. to cover plates having corresponding shapes. In addition, a wide variety of fastener mechanisms can be employed to secure the first covering portion to the second covering portion to enclose the border of the plate. With these arrangements, a plate cover assembly of the present disclosure is used to selectively decorate or transform an otherwise ordinary plate into a seasonal decoration or to become part of a larger motif. Moreover, plate cover assemblies of the present disclosure also can be used to protect a border of a plate that already has sensitive or decorative features.

These examples, and additional examples, are further described and illustrated in association with FIGS. 1-34.

Figure 1:
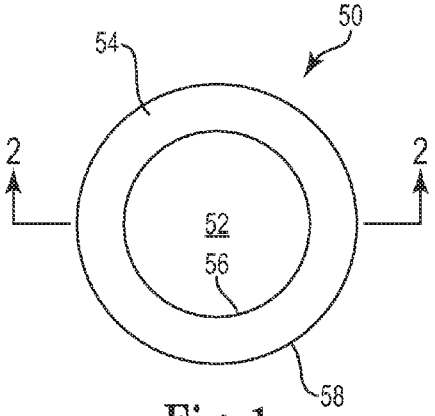
FIG. 1 is a top plan view of an example plate.
Figure 2:
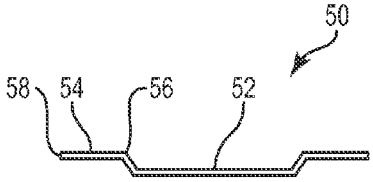
FIG. 2 is a side view of an example plate.

FIG. 1 is a top plan view schematically illustrating a dinner plate 50 having a generally circular configuration. As shown in FIG. 1, the dinner plate 50 includes a central region 52 with a border 54 arranged concentrically about the central region 52. The border 54 includes an inner edge 56 and an outer edge 58, which also defines an outer edge of plate 50. Plate 50 is further illustrated in the side view of FIG. 2.

Figure 3:
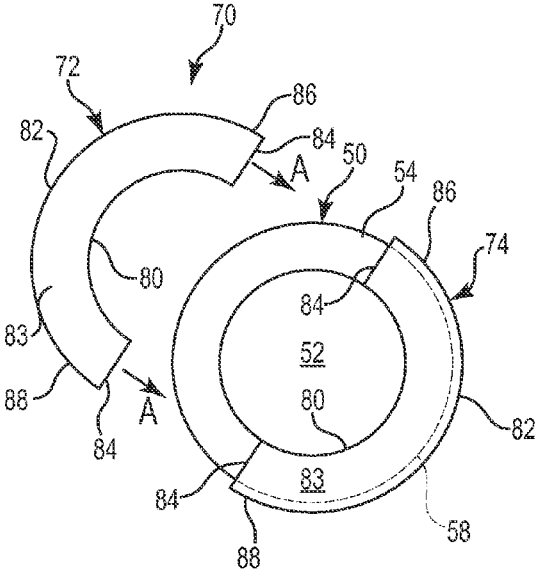
FIG. 3 is a top plan view schematically illustrating installation of an example plate cover assembly.

FIG. 3 is a top plan view schematically illustrating an example plate cover assembly 70 being mounted on a dinner plate 50. As shown in FIG. 3, the plate cover assembly 70 includes a first portion 72 and a second portion 74. In one example, first portion 72 defines a first half and second portion defines a second half with each respective half generally defining a semi-annular portion. Each respective first and second portion 72, 74 includes an inner edge 80, an outer edge 82, and a face portion 83 therebetween. In some instances, this face portion 83 will be referred to as a body portion because it extends between inner edge 80 and outer edge 82. In other instances, the term face portion 83 is used because it emphasizes the portion of the cover assembly 70 that faces upward in a line of sight of a person using the plate and is at least one portion on which any decorations, symbols, and/or information would appear. Each first and second portion 72, 74 also includes a first end 86 and a second end 88, with each respective end 86, 88 defining an end surface 84.

As shown in FIG. 3, second portion 74 already has been removably installed onto plate 50 and first portion 72 is being moved (as represented via directional arrows A) toward plate 50 to complete installation of the plate cover assembly 70.

Figure 4:
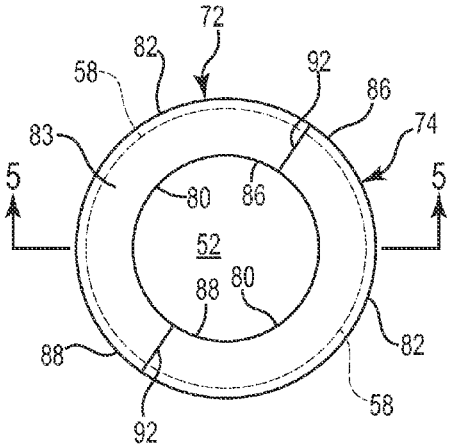
FIG. 4 is a top plan view of a plate cover assembly installed on a plate.

Accordingly, the first portion 72 is slidably advanced onto outer edge 58 of plate 50 and advanced until the end surfaces 84 of first portion 72 and releasably contacts the end surfaces 84 of second portion 72 (as represented by seams 92 in FIG. 4) to form the completed plate cover assembly 70, as shown in FIG. 4.

Accordingly, each first and second portion 72, 74 defines a half ring-shaped shell structure into which an outer edge 58 of plate 50 can be slidably inserted, such as shown in FIG. 3. The dashed lines 58 in FIG. 3 represent the outer edge of plate 50 once it has been slidably inserted into the half ring-shaped, shell structure defined by second portion 74 of plate cover assembly 70.

As previously noted, in some examples, the face portion 83 includes at least one decorative element, symbol, or other information to enable temporarily augmenting the appearance of a dinner plate without permanently altering the dinner plate. Because the plate cover assembly is removably attachable, one can easily and quickly switch from one plate cover assembly having a first decoration or information to a different plate cover assembly having a different, second decoration or information.

It will be further understood that FIGS. 3-4 omit such decorations, symbols or information for illustrative clarity regarding the separation and attachment of the two half ring portions 72, 74. However, in some examples, the decorations, symbols, and/or information described and illustrated in association with at least FIGS. 30-31 can be implemented onto the face portion 83 of cover assembly 70. Furthermore, in some examples, such decorations, symbols, and/or information (described and illustrated in association with at least FIGS. 30-31) are implemented in the following examples described and illustrated in association with FIGS. 5-29 and 34.

Figure 5:
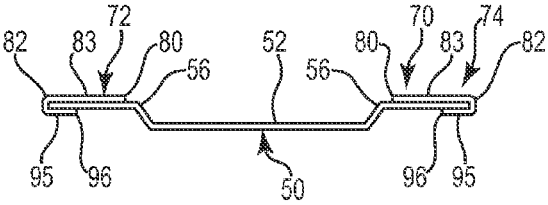
FIG. 5 is a sectional view taken along lines 5-5 of the installed plate cover assembly of FIG. 4.
Figure 6:
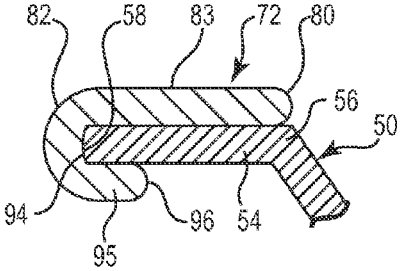
FIG. 6 is a partial enlarged sectional view of a plate cover on a plate.

FIG. 5 is a sectional view as taken along lines 5-5 of FIG. 4, further illustrating the example plate cover assembly 70. FIG. 6 is a partial sectional view like FIG. 5, except enlarged to further illustrate the plate cover assembly 70 when mounted or installed on plate 50.

As shown in FIGS. 5-6, each first and second portion 72, 74 includes an upper portion defined by face portion 83 and a lower portion 95. In this arrangement, plate cover assembly 70 extends over the border 54 of plate 50 while leaving central region 52 uncovered.

Moreover, in general terms, an outer edge 82 of the each first and second portion 72, 74 is configured to at least partially receive the outer edge 58 of the plate 50. In one example, the lower lip portion 95 (of each respective portion 72, 74 of plate cover assembly 70) extends from outer edge 82 inwardly toward the central region 52 of plate 50, with lower lip portion 95 sized and shaped to curvably extend around and underneath the outer edge 58 of plate 50, as shown in FIGS. 5-6.

FIGS. 7-16B illustrate various fastening mechanisms by which the respective first and second portions 72, 74 are removably secured together and thereby removably mounted onto plate 50. In general terms, the first end 86 of half ring portion 72 includes a first engagement portion and the first end 86 of half ring portion 74 includes a second engagement portion, wherein the first end of the first half ring portion 72 is releasably secured to the first end of the second half ring portion 74 via interaction of the respective first and second engagement portions. In addition, the second end 88 of half ring portion 72 includes a first engagement portion and the second end 88 of half ring portion 74 includes a second engagement portion, wherein the second end 88 of the first half ring portion 72 is releasably secured to the second end 88 of the second half ring portion 74 via interaction of the respective first and second engagement portions.

Figure 7:
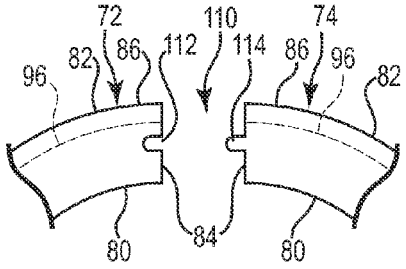
FIG. 7 is partial top plan view schematically illustrating a fastener portion of an example plate cover assembly.

FIG. 7 is partial top plan view of an end 86 of first portion 72 positioned adjacent end 86 of second portion 74 and in alignment to removably secure the respective portions 72, 74 together via interaction of a first and second engagement portion. As shown in FIG. 7, in this example, plate cover assembly 70 includes a fastener mechanism 110 including a recess or hole 112 (e.g. one of the first and second engagement portions) defined in one end surface 84 of the end 86 of first portion 72 and a projection 114 (the other of the first and second engagement portions) on an opposite end surface 84 of the end 86 of second portion 74 such that projection 114 slidably, removably engages recess 112 to fasten ends 86 of the respective first and second portions 72, 74, as shown in FIG. 4. In one aspect, the projection 114 frictionally engages or snap fits within recess 112.

Figure 8:
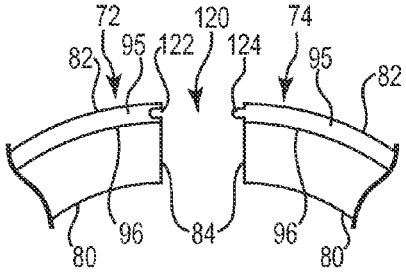
FIG. 8 is a partial bottom plan view schematically illustrating a fastener portion of an example plate cover assembly.

FIG. 8 is a partial bottom plan view of the arrangement shown in FIG. 7 and illustrating a second fastener mechanism 120 including a recess 122 and a projection 124. The recess 122 (one of the first and second engagement portions) is defined in end surface 84 on lower lip portion 95 of first portion 72 while projection 124 (the other respective one of the first and second engagement portions) is defined on end surface 84 of lower lip portion 95 of second portion 74. Removable engagement of the recess 122 and projection 124 removably secures the first portion 72 relative to the second portion 74. Because the second fastener mechanism 120 is generally located on lower lip portion 95, it is generally located underneath the border 54 of the plate 50 and therefore not generally visible from the top of plate 50. In one example, the second fastener mechanism 120 is used in addition to fastener mechanism 110 and in other examples, second fastener mechanism 120 is used instead of fastener mechanism 110.

Figure 9:
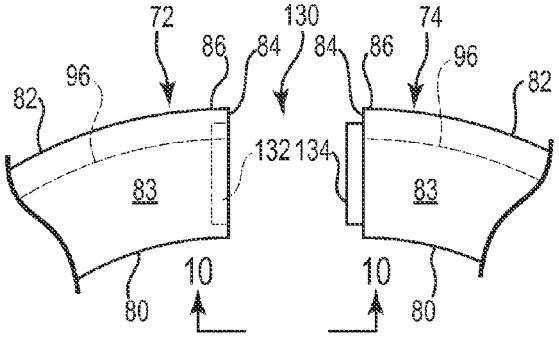
FIG. 9 is partial top plan view schematically illustrating a fastener portion of an example plate cover assembly.
Figure 10:
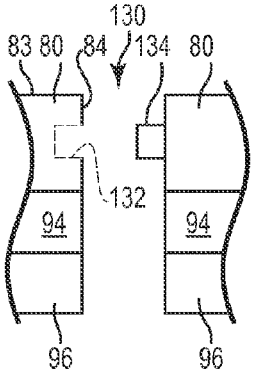
FIG. 10 is a partial side plan view schematically illustrating a fastener portion of an example plate cover assembly.

FIG. 9 is a partial top plan view in which the fastener mechanisms 110, 120 (FIGS. 7-8) are replaced by an example fastener mechanism 130. As shown in FIG. 9, fastener mechanism 130 includes a first elongate recess 132 (on end surfaces 84 of first portion 72) and a first elongate projection 134 (on end surfaces 84 of second portion 74). The recess 132 comprises one of a first and second engagement portion while projection 134 comprises the other respective one of the first and second engagement portions. Removable engagement or interaction of the projection 134 and the recess 132 acts to removably secure the respective first and second portions 72, 74 together in a manner to produce a completed plate cover assembly substantially similar to that shown in FIG. 4. FIG. 10 is side view taken along lines 10-10 of FIG. 9, and further illustrates the respective recess 132 and projection 134 of fastener mechanism 130.

Figure 11:
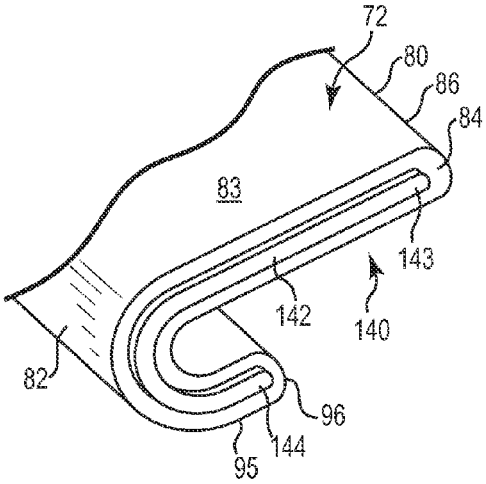
FIGS. 11-12 are perspective views schematically illustrating reciprocating fastener portions of an example plate cover assembly.
Figure 12:
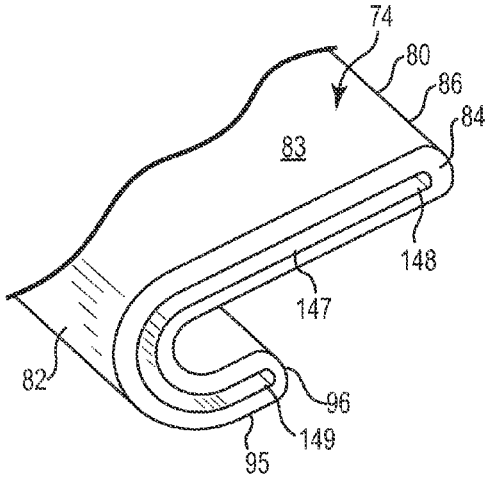

FIGS. 11-12 are perspective views schematically illustrating an example fastener mechanism 140. As shown in FIG. 11, fastener mechanism 140 includes an elongate protrusion 142 on end surfaces 84 of first portion 72 and an elongate recess 147 on end surfaces 84 of second portion 74, as shown in FIG. 12. Elongate protrusion 142 includes a first end 143 and a second opposite end 144, and as shown in FIG. 11, in one example elongate protrusion 142 extends substantially the entire length of end surface 84. Elongate recess 147 includes a first end 148 and a second opposite end 149, and as shown in FIG. 12, in one example elongate protrusion 147 extends substantially the entire length of end surface 84. The recess 147 comprises one of a first and second engagement portion while projection 142 comprises the other respective one of the first and second engagement portions. Removable engagement or interaction of the projection 142 and the recess 147 acts to removably secure the respective first and second portions 72, 74 together in a manner to produce a completed plate cover assembly substantially similar to that shown in FIG. 4.

Moreover, it will be understood that end surface 84 of second portion 74 is shown in FIG. 12 with a reverse orientation for illustrative purposes and that in actuality elongate recess 147 is aligned on end surface 84 of second portion 74 in a manner to reciprocally removably engage projection 142 on end 84 of first portion 72.

Figure 13:
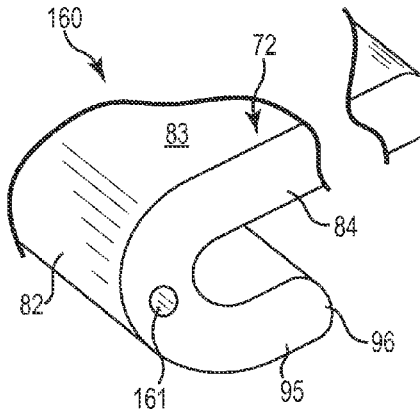
FIGS. 13-14 are perspective views schematically illustrating reciprocating fastener portions of an example plate cover assembly.
Figure 14:
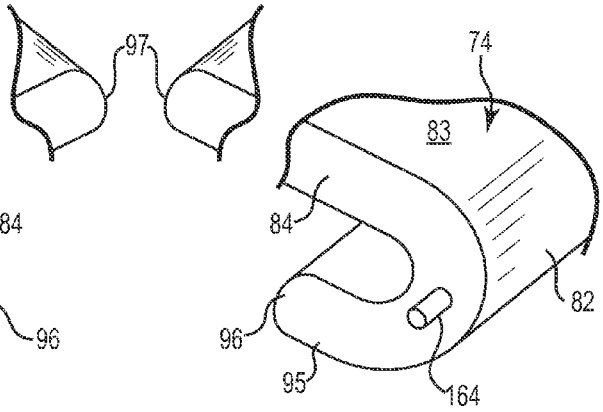

FIGS. 13-14 are perspective views schematically illustrating an example fastener mechanism 160. As shown in FIG. 13, fastener mechanism 160 includes a recess or hole 161 defined within end surfaces 84 of first portion 72 and a pin 164 protruding directly from end surfaces 84 of second portion 74, as shown in FIG. 14. The recess 161 comprises one of a first and second engagement portion while pin 164 comprises the other respective one of the first and second engagement portions, the interaction of which releasably secure together the first and second half ring portions. While FIGS. 13-14 show the respective hole 161 and pin 164 located at the outer edge 82 of the respective first and second portions 72, 74, it will be understood that hole 161 and pin 164 can be located elsewhere along the end surface 84 between end 96 and end 97, provided that they remain in a reciprocating relationship relative to one another.

Figure 15A:
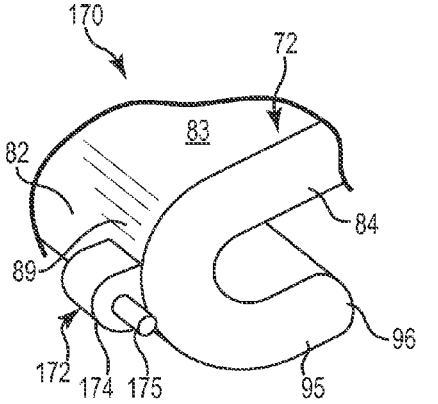
FIGS. 15A-15B are perspective views schematically illustrating reciprocating fastener portions of an example plate cover assembly.
Figure 15B:
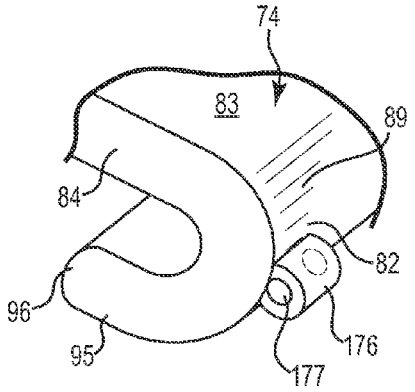

FIGS. 15A-15B are perspective views schematically illustrating an example fastener mechanism 170 including a pin portion 172 and a hole portion 177. Unlike the pin 164 and recess 161 combination of the fastener mechanism 160 in FIGS. 13-14, the pin portion 172 and hole portion 177 of fastener mechanism 170 are mounted laterally of the end surface 84 on an exterior portion 89 of outer edge 82 of the first and second cover portions 72, 74. As shown in FIG. 15A, pin portion 172 includes a base 174 and a pin 175 while hole portion 177 is defined within sleeve 176. The pin portion 172 comprises one of a first and second engagement portion while hole portion 177 comprises the other respective one of the first and second engagement portions. Removable engagement or interaction of the pin portion 172 and the hole portion 177 acts to removably secure the respective first and second portions 72, 74 together in a manner to produce a completed plate cover assembly substantially similar to that shown in FIG. 4.

Figure 16A:
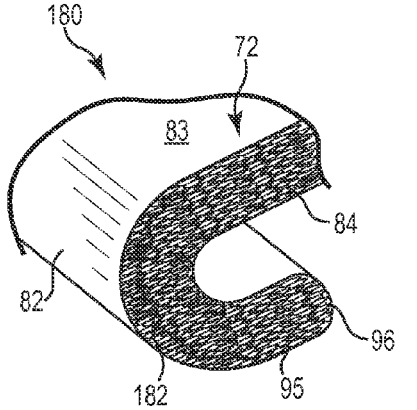
FIGS. 16A-16B are perspective views schematically illustrating reciprocating fastener portions of an example plate cover assembly.
Figure 16B:
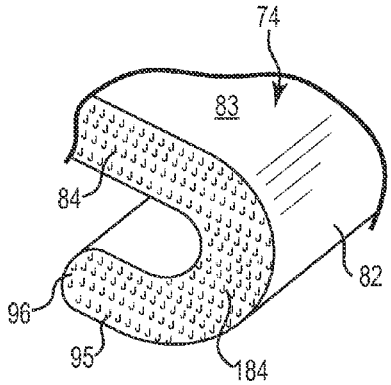

FIGS. 16A-16B are perspective views schematically illustrating an example fastener mechanism 180 including a hook portion 184 and a loop portion 182 of a hook and loop fastener. Accordingly, upon the end surfaces 84 of first portion 72 being moved into contact against the end surfaces 84 of second portion 74, the hook portion 184 and loop portion 182 releasably engage each other to secure the first portion 72 relative to the second portion 74, resulting in the completed assembly shown in FIG. 4. In one example, each of the hook portion 184 and the loop portion 182 are provided via a strip that is adhesively secured to a respective end surface 85 of the respective first and second portion 72, 74 of plate cover assembly 70. The hook portion 184 comprises one of a first and second engagement portion while loop portion 182 comprises the other respective one of the first and second engagement portions. Removable engagement or interaction of the hook portion 184 and the loop portion 182 acts to removably secure the respective first and second portions 72, 74 together in a manner to produce a completed plate cover assembly substantially similar to that shown in FIG. 4. In addition, in some examples, hook-and-loop fastener mechanism 180 is deployed alongside other types of fastener mechanisms described herein.

In some embodiments, a reusable pressure sensitive adhesive is arranged on the end surfaces 84 of the respective first and second portions 72, 74. In one example, the reusable pressure sensitive adhesive comprises the sole fastener mechanism to removably secure the first and second portions 72, 74 together. However, in other examples, the reusable pressure sensitive adhesive is deployed in combination with at least one of the other types of fastener mechanisms described herein, such as in FIGS. 7-16B or FIGS. 21-25.

The examples of the plate cover assembly 70 as described in association with FIGS. 3-16B includes two separate portions 72, 74 (e.g. two halves) that are joined together to form a complete assembly. In other examples, a plate cover assembly is formed as a complete annular ring (not separable portions) and is mounted via vertically advancing the single piece cover downward onto plate 50 until the outer edge 82 of the plate cover slidably snaps fits onto and around the outer edge 52 of plate 50.

Figure 17:
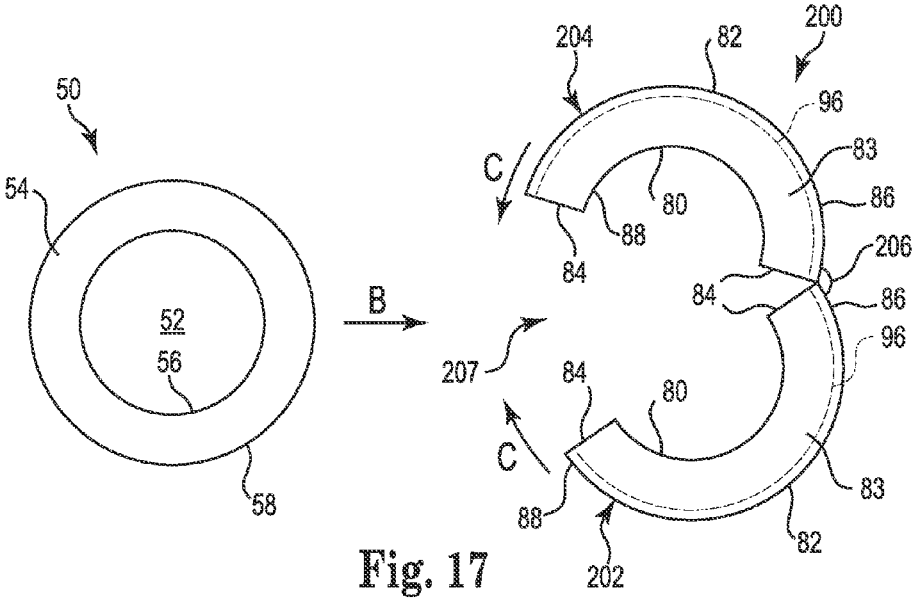
FIG. 17 is a top plan view schematically illustrating mounting an example plate cover assembly onto a plate.

FIG. 17 is a top plan view schematically illustrating an example plate cover assembly 200 being mounted on a plate 50. As shown in FIG. 17, plate cover assembly 200 includes a first half ring portion 202 and a second half ring portion 204, with each defining a generally semi-annular shape. The plate cover assembly 200 comprises substantially the same features and attributes as plate cover assembly 70 (FIGS. 3-6) except that for plate cover assembly 200, the ends 86 of first portion 202 and second portion 204 are hingedly connected together via a hinge mechanism 206. In one example, the hinge mechanism 206 comprises a living hinge formed via injection molding simultaneously with formation of the respective first and second portions 202, 204 such that the first portion 202, second portion 204, and living hinge 206 form a single, unitary piece from their inception with the living hinge 206 extending between the first half ring portion 202 and the second half ring portion 204. Accordingly, unlike the separate first and second portions 72, 74 of plate cover assembly 70, the first and second portions 202, 204 of plate cover assembly 200 are not completely separable from each other. Rather, via pivotal movement about living hinge 206, one rotates or pivots first portion 202 away from second portion 204 to create an open mouth 207 (FIG. 17) to enable installation of plate cover assembly 200 on plate 50. While many materials can be used to form the plate cover assembly via injection molding, some examples include materials such as polyethylene or polypropylene, which have properties that accentuate the resiliency and fatigue resistance of the living hinge 206.

With the plate cover assembly 200 in the open position shown in FIG. 17, plate 50 is moved (as represented by directional arrow B) into a position between the spaced apart first portion 202 and second portion 204. Via pivotal movement about hinge mechanism 206, the free ends 88 of first portion 202 and second portion 204 are rotated inward toward each other (as represented by directional arrows C) to a closed position. Upon completion of this maneuver, the plate cover assembly 200 takes substantially the same configuration as previously shown in association with FIG. 4 such that the complete ring defines a central hole that exposes a central region of a plate and the complete ring generally covers an outer border portion of the plate (that concentrically encircles the central region of the plate). In addition, to maintain the first and second portions 202, 204 in removably secure contact with each other, plate cover assembly 200 employs at least one of the various fastener mechanisms 110, 120, 130, 140, 160, 170, 180 (as previously described and illustrated in association with FIGS. 7-16B) that include a first and second engagement portion that are releasably securable relative to each other in order to removably secure the ends 88 together. In this way, the first and second portions 202, 204 form a complete ring defining a generally annular shape in which the respective first and second half ring portions remain in substantially the same plane in both the open and closed positions.

Figure 18A:
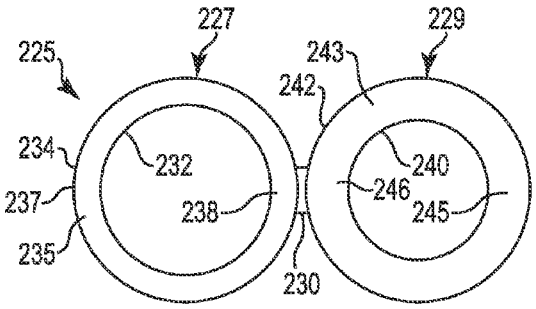
FIG. 18A is a top plan view of an example plate cover assembly.

FIG. 18A is a top plan view of an example plate cover assembly 225. As shown in FIG. 18A, plate cover assembly 225 includes a first ring portion 227 and a second ring portion 229, which are connected together via a hinge mechanism 230 at an inner portion 238, 246 of the respective first and second ring portions 227, 229. In one example, the hinge mechanism 230 comprises a living hinge having substantially the same features and attributes as previously described in association with plate cover assembly 200 of FIG. 17. Accordingly, pivotal movement about the living hinge enables conversion of the plate cover assembly between its open and closed positions. In addition, as in the prior example of FIG. 17, the first ring portion 227, the second ring portion 229, and the hinge mechanism 230 (such as a living hinge) are molded simultaneously as a single, unitary piece with the living hinge extending between the respective first and second ring portions 227, 229.

First portion 227 generally defines a ring or annular portion have an inner curved edge 232, outer curved edge 234, with body portion 235 extending therebetween. In addition, when connected to second portion 229 via living hinge 230, the first portion 227 further defines inner portion 238 and outer portion 237. Likewise, second portion 229 generally defines a ring or annular portion have an inner curved edge 240, outer curved edge 242, with body portion 243 extending therebetween. In addition, when connected to first portion 227 via living hinge 230, the second portion 229 further defines inner portion 246 and outer portion 245.

Figure 18B:
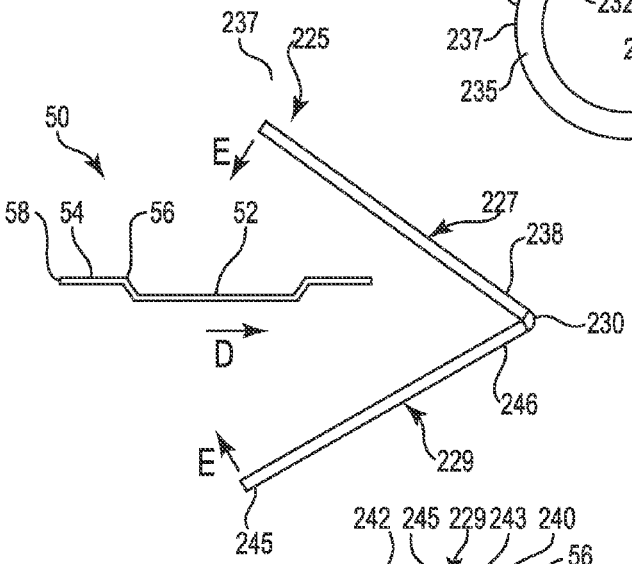
FIG. 18B is a side view schematically illustrating mounting an example plate cover assembly onto a plate.

With the plate cover assembly 200 in the open position shown in FIG. 18B, plate 50 is moved (as represented by directional arrow D) into a position between the spaced apart first portion 227 and second portion 229, and then the first portion 227 and second portion 229 are rotated (as represented by directional arrows E) relative to living hinge so that their at least one segment of free end 237 and at least one segment of free end 245 become removably secured together. In this way, a plate becomes at least partially sandwiched between the respective first and second portions 227, 229 of the plate cover assembly 200. Upon completion of this maneuver, the plate cover assembly 225 encloses plate 50 in generally the same manner as previously shown for plate cover assembly 70 in association with FIG. 4. In addition, to maintain the first and second portions 227, 229 in removably secure contact with each other, plate cover assembly 225 employs at least one of the various fastener mechanisms 110, 120, 130, 140, 160, 170, and 180, as previously described and illustrated in association with FIGS. 7-16B. In one aspect, the employed fastening mechanism includes a first and second engagement portion that are releasably securable relative to each other in order to releasably secure together the at least one segment of free end 237 to the at least one segment of free end 245 of the respective first and second portions 227, 229.

In one aspect, this arrangement results in a complete ring defining a generally annular shape having a central hole that exposes a central region of a plate while the ring generally covers a border portion of the plate. In another aspect, the first and second ring portions 227, 229 extend in substantially the same plane when the plate cover assembly is in the closed position and extend in different planes when the plate cover assembly is in the open position.

In another aspect, in the closed position, the first ring 227 and the second ring 229 are non-rotatable relative to each other in a plane generally parallel to a plane through which the plate generally extends.

Figure 19:
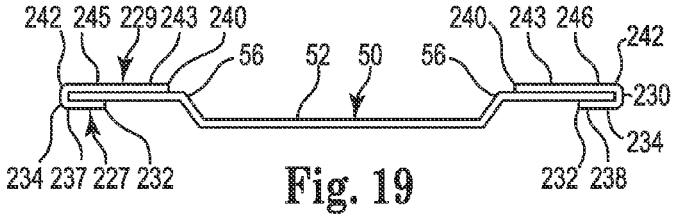
FIG. 19 is a sectional view schematically illustrating an example plate cover assembly after installation on a plate.

FIG. 19 is a sectional view of plate cover assembly 225 after mounting on plate 50, with cross-hatching omitted for illustrative clarity. As shown in FIG. 19, outer portion 237 of first portion 227 is removably secured relative to outer portion 245 of second portion 229 and inner portion 238 of first portion 227 is maintained in close proximity to inner portion 246 of second portion 229 via living hinge 230. In this configuration, border 54 of plate 50 is enclosed by plate cover assembly 225 with first portion 227 positioned on top of plate 50 and with second portion 229 positioned underneath plate 50, as shown in FIG. 19, while still leaving central region 52 of plate 50 exposed.

Figure 20:
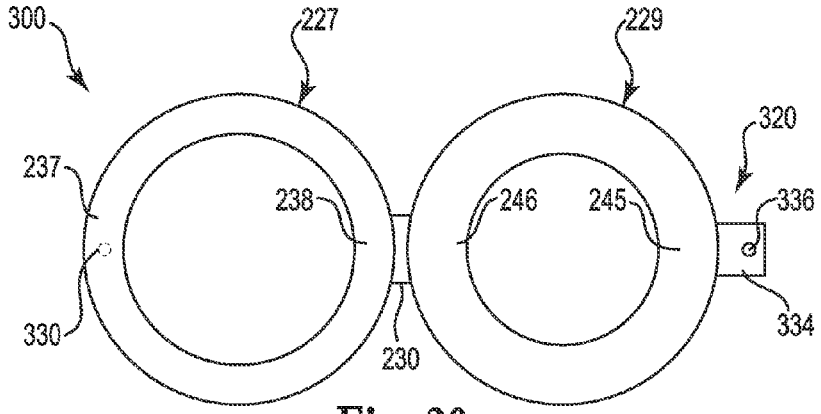
FIG. 20 is a top plan view schematically illustrating an example plate cover assembly.

FIG. 20 is a top plan view of an example plate cover assembly 300 having substantially the same features and benefits as plate cover assembly 225 (FIGS. 18-19) except including a particular type of fastener mechanism 320 for removably securing the free end portions 237, 245 of the respective first and second portions 227, 229. As further shown in FIG. 20, fastener mechanism 320 includes a flap 334 and a pin 330. The flap 334 (one of a first and second engagement portion) extends generally outward from outer portion 245 of second portion 229 while pin 330 (the other respective one of a first and second engagement portion) extends outwardly from a bottom surface of outer portion 237 of first portion 227. Upon rotating the first and second portions 227, 229 toward each other to enclose a plate 50, the flap 334 is used to removably secure the second portion 229 relative to the first portion 227.

Figure 21:
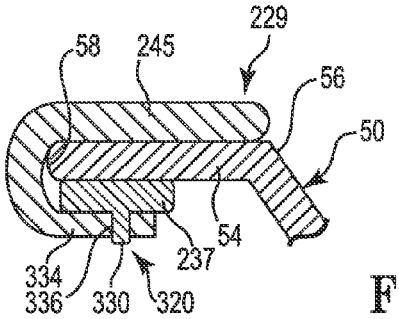
FIG. 21 is a sectional view schematically illustrating reciprocating fastener portions of an example plate cover assembly after installation on a plate.
Figure 21:
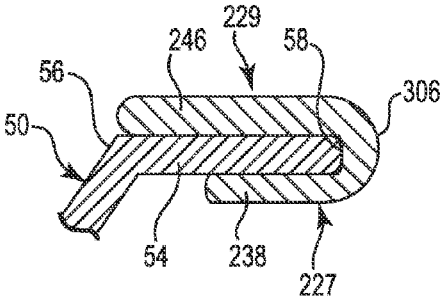

Accordingly, as shown in FIG. 21, with outer portion 245 of second portion 229 resting on top of border 54 of plate 50, flap 334 extends about outer edge 58 of plate 50 to position hole 336 over pin 330, which extends outward from a bottom portion of first portion 227. Meanwhile, the respective inner portions 238, 246 of the respective first and second portions 227, 229 remain in close proximity to each other via operation of living hinge 230.

Figure 22:
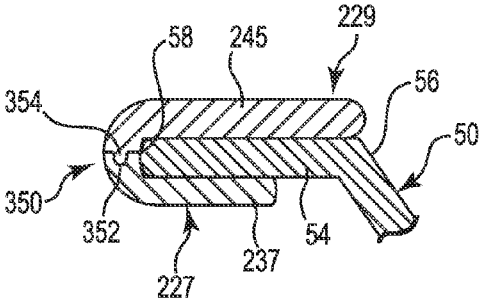
FIG. 22 is a sectional view schematically illustrating reciprocating fastener portions of an example plate cover assembly after installation on a plate.
Figure 23:
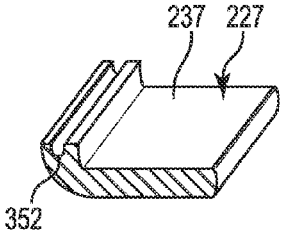
FIG. 23 is a sectional view schematically illustrating a fastener portion of an example plate cover assembly.
Figure 24:
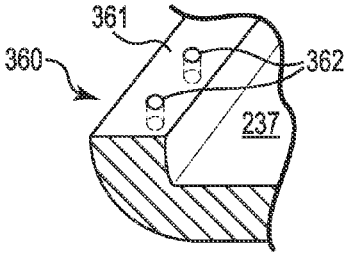
FIGS. 24-25 are partial sectional views schematically illustrating reciprocating fastener portions of an example plate cover assembly.

In some examples, in place of or in addition to the fastener mechanism 320 provided via flap 334 and pin 330, the plate cover assembly 300 includes at least one of the fastener mechanisms 350 or 360 as described in association with FIGS. 22-24. For example, FIG. 22 is a sectional view of a fastener mechanism 350 used to removably secure the free end portions 237, 245 of the respective first and second portions 227, 229 of plate cover assembly 300 (FIG. 20). As shown in FIG. 22, fastener mechanism 350 includes a tongue portion 354 (one of a first and second engagement portion) protruding from an end surface of outer portion 245 and a groove portion 352 (the other respective one of the first and second engagement portions) recessed within an end surface of outer portion 237. With this arrangement, tongue portion 354 snap fits or friction fits within groove portion 352 to removably secure outer portion 245 of second portion 229 relative to outer portion 237 of first portion 227. FIG. 23 further illustrates the groove portion 352 formed in end surface of outer portion 237 of first portion 227.

Figure 25:
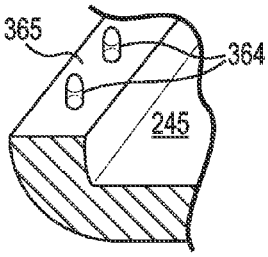

FIGS. 24-25 are perspective views of an example fastener mechanism 360. As shown in FIGS. 24-25, fastener mechanism 360 includes a plurality of holes 362 (one of a first and second engagement portion) formed in an end surface 361 of outer portion 237 of first portion 227 (FIG. 24) and a plurality of pins 364 (the other respective one of the first and second engagement portions) protruding outward from end surface 365 of outer portion 245 second portion 229 (FIG. 25), with the respective pins 364 and holes 362 aligned, shaped, and sized to reciprocate with each other. It will be understood that FIG. 25 depicts outer portion 245 in a reverse (upside down) orientation for illustrative purposes, as in use pins 364 are aligned to reciprocally engage holes 362. Via a friction fit or snap fit action, the pins 364 and holes 362 engage each other to hold the first portion 227 and second portion 229 in secure engagement with each other about plate 50.

Figure 26:
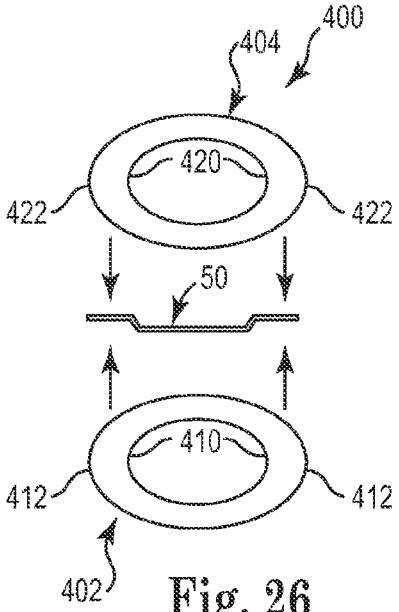
FIG. 26 is a side and perspective view schematically illustrating two halves of an example plate cover assembly being mounted on a plate.

FIG. 26 is a perspective exploded view of an example plate cover assembly 400. As shown in FIG. 26, plate cover assembly 400 includes a first ring portion 402 and second ring portion 404 which are removably securable together to enclose a plate 50 therebetween. In one example, first portion 402 and second portion 404 comprise substantially the same features and attributes as first portion 227 and second portion 229 (FIG. 18A), except that first and second portions 404 are not joined via a living hinge. Accordingly, by positioning second portion 404 on top of plate 50 and positioning first portion 202 underneath plate 50, plate cover assembly 400 sandwiches plate 50 therebetween.

In one example, the second portion 404 is removably secured relative to first portion 402 via at least one of the types of fastener mechanisms (providing first and second engagement portions) as previously described and illustrated in association with FIGS. 21-25 or FIGS. 7-16B.

Figure 27A:
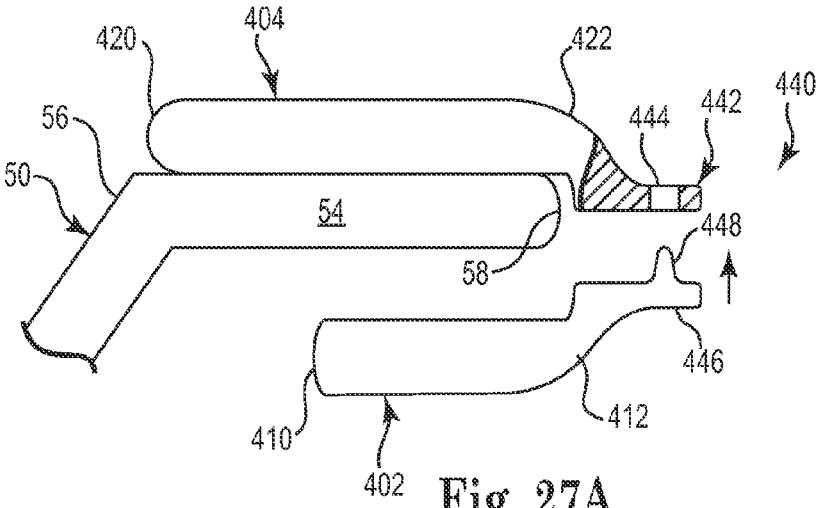
FIG. 27A is a partial sectional view schematically illustrating reciprocating fastener portions of an example plate cover assembly during installation on a plate.
Figure 27B:
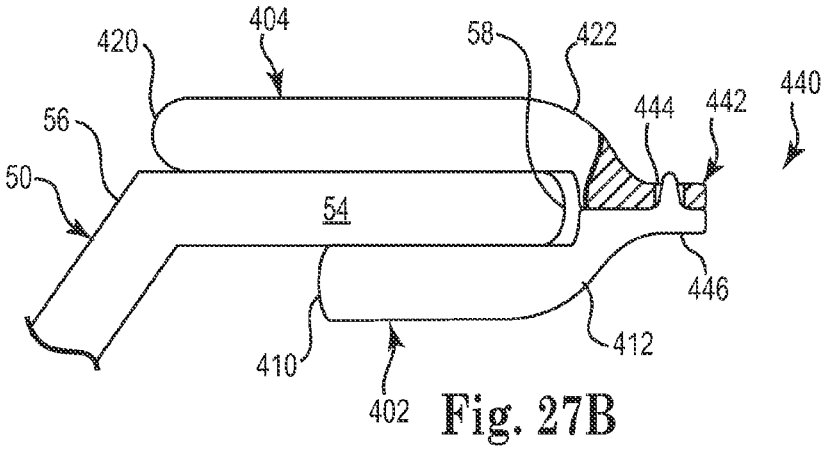
FIG. 27B is a partial sectional view schematically illustrating reciprocating fastener portions of an example plate cover assembly after installation on a plate.

As shown in FIGS. 27A-27B, in one example the plate cover assembly 400 includes fastener mechanism 440. As shown in FIG. 27A, fastener mechanism 440 includes a pin portion 448 (one of a first and second engagement portion) extending from outer edge 412 of the opposite sides of first portion 402 and includes a hole portion 444 (the other respective one of the first and second engagement portions) extending from the outer edge 422 of opposite sides of second portion 404. Upon moving second portion 404 toward and against first portion 402, pin portion 448 engages (via friction fit or snap fit) hole portion 444 to removably secure second portion 404 against first portion 402 to thereby enclose plate 50 therebetween, as shown in FIG. 27B.

Figure 28:
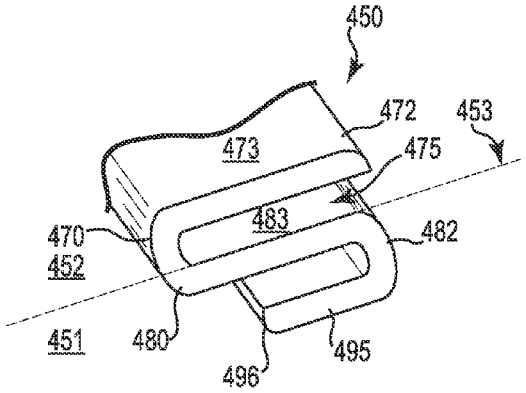
FIG. 28 is a perspective view of an example plate cover assembly.
Figure 29:
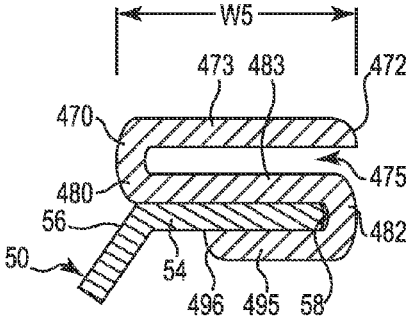
FIG. 29 is a side sectional view of an example plate cover assembly after installation on a plate.

FIG. 28 is a perspective view schematically illustrating an example plate cover assembly 450 while FIG. 29 is a sectional view further illustrating the example plate cover assembly 450. In general terms, plate cover assembly 450 includes two portions, each having a generally semi-circular ring configuration in a manner substantially similar to the plate cover assembly 70 of FIGS. 3-4, in which the end surfaces of two half portions are removably secured together (via interaction of a first engagement portion and a second engagement portion) to form a completed plate cover assembly. For illustrative purposes to highlight its cross-sectional profile, an end portion of just one of the two half portions of plate cover assembly 450 is shown in FIGS. 28-29.

As shown in FIGS. 28-29, plate cover 450 includes a lower portion 451 and an upper portion 452 with dashed line 453 representing their functional separation. The bottom portion 451 has a configuration have substantially the same features and attributes as plate cover assembly 70 of Figure while the upper portion 452 extends from and is positioned over the lower portion 451. In particular, lower portion 451 includes lower lip 495, outer edge 482, mid portion 483, and inner edge 480. Upper portion 451 defines a face portion 473 extending between an inner edge 470 and an outer edge 472, with inner edge 470 extending upward from inner edge 480 of lower portion 451. In one aspect, face portion 473 of upper portion 452 extends generally parallel to and is vertically spaced apart from mid portion 483 of lower portion 451 to define a gap or slot 475 therebetween. In one aspect, the slot 475 faces radially outward relative to outer edge 472 and is sized and shaped to receive a ring insert, which is described below. In another aspect, face portion 473 of upper portion 452 has a width (W5) that is substantially the same as a width of face portion 483 of lower portion 451.

Figure 30:
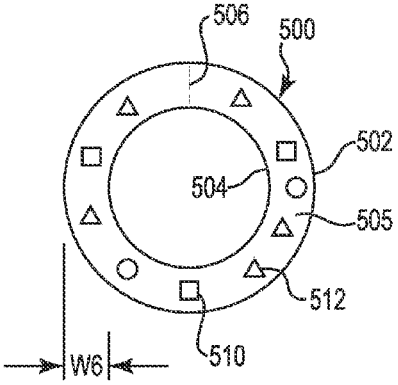
FIG. 30 is a top plan view schematically illustrating an example split ring insert for an example plate cover assembly.

In one example, at least face portion 473 is transparent or translucent, and once the plate cover assembly 450 is installed on a plate 50 (FIG. 1), an informational or decorative ring, such as split ring insert 500 in FIG. 30, is inserted into the slot 475 and fit about inner edge 470 of plate cover assembly 450.

In one example, as shown in FIG. 30, split ring insert 500 includes an outer edge 502, an inner edge 504 and a face portion 505 having a width (W6) generally equal to the width of face portion 473 (W5) of plate cover assembly 450. The ring 500 includes a plurality of symbols 510, 512 arranged on face portion 473. The ring 500 also includes a separable seam 506 allowing the ring 500 to be temporarily split to enable installation into the slot 475 of plate cover assembly 450 via separating ends of the split ring 500 for maneuvering into the slot 475 and about a periphery of the plate cover until the free ends of the split ring 400 are again closely adjacent to each other. In this fully inserted position within slot 475, an outer edge of the ring insert generally coincides with the outer edge of the plate cover assembly 450.

With this arrangement, the symbols 510, 512 on ring insert 500 become visible through face portion 473 of plate cover assembly 450. In this way, with plate cover assembly 450 providing a semi-permanent cover, allowing different rings 500 can be installed to provide different messages via symbols 510, 512. In one example, the symbols 510, 512 represent a seasonal theme (e.g., Thanksgiving) or a particular motif (e.g., Western). In other examples, symbols 510, 512 represent an organization, belief, motto, etc.

In some embodiments, the symbols also can be directly placed on face portion 473 of plate cover assembly 450, if desired.

Figure 31:
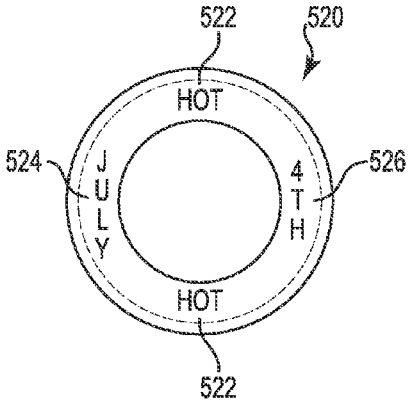
FIG. 31 is a top plan view schematically illustrating an example plate cover assembly.

FIG. 31 is top plan view of an example plate cover assembly 520 having the general configuration of that shown in FIGS. 1-27B. As shown in FIG. 31, the informational portions 522, 524, 526 represent seasonal information (e.g., July $4^{th}$) or warning/handling information (e.g., Hot).

Figure 32:
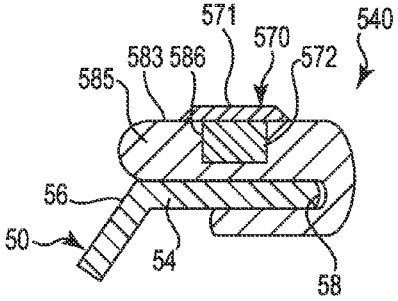
FIG. 32 is a side sectional view schematically illustrating an example plate cover assembly.
Figure 33:
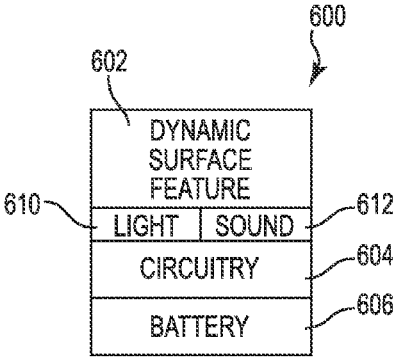
FIG. 33 is a block diagram schematically illustrating an example surface feature for a plate cover assembly.

FIG. 32 is a sectional view of an example plate cover assembly 540, which includes one of the various configurations for assembly as previously described in association with FIGS. 1-27B. However, in this example, as shown in FIG. 32, a face portion 583 of plate cover assembly 540 bears a surface feature 570 having a visible portion 571 protruding generally outward relative to face portion 583. In one example, the feature 570 also includes an anchor portion 572 secured within body 585 of face portion 583. In some examples, feature 570 is permanently secured relative to face portion 583, while in other examples, feature 570 is removably secured relative to face portion 583, such as via friction fitting or snap fitting anchor portion 572 within hole 586 of body 585 of face portion 583. Accordingly, hole 586 removably receives the anchor portion 572 of the feature 570 and the visible upper portion 571 extends generally upward from the anchor portion 572 to protrude from, and be exposed, at a surface of the face portion 583. In some examples, the visible portion 571 is decorative while in other examples, visible portion 571 is informational.

In one example, a plurality of features 570 is mounted on face portion 583 in a generally ring or annular configuration such as the symbols 510, 512 in FIG. 30.

In one example, feature 570 is a dynamic surface feature. In one aspect, dynamic surface feature 570 is deployed in the manner shown in FIG. 33, in which the feature 600 includes a dynamic surface feature 602 (corresponding to visible portion 571 in FIG. 32), circuitry 604, and battery 606. Accordingly, in one aspect, dynamic surface feature 602 includes an electrically active element. In one example, the anchor portion 572 (FIG. 32) houses circuitry 604 and battery 606, which communicate with and control operation of dynamic surface feature 602. In one example, surface feature 602 provides illumination 610 while in another example, surface feature 604 provides audible sounds 612 (e.g. music, song, spoken message). In some examples, dynamic surface feature 602 provides both illumination and audible sounds.

Figure 34:
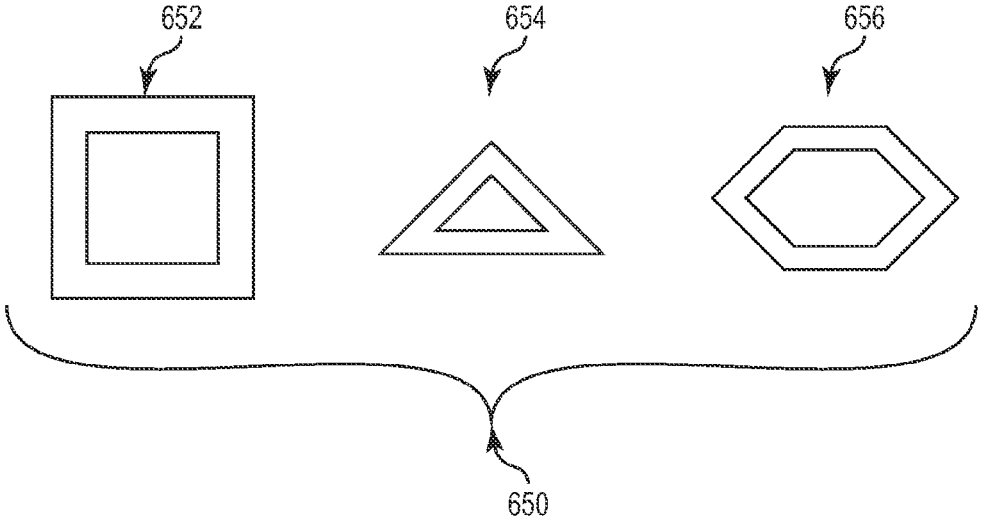
FIG. 34 is a diagram schematically illustrating an array of an example plate cover assembly.

FIG. 34 is a diagram illustrating an array 650 of alternate shapes 652-656 in which a plate cover can be embodied. In one aspect, these differently shaped, plate cover assemblies are deployed according to the various configurations and fastener mechanisms as previously described in association with FIGS. 3-33. With this in mind, as shown in FIG. 34, a plate cover assembly can be embodied as a generally rectangular shape 652 to cover a generally rectangular shaped plate, as a generally triangular shape 654 to cover a generally triangular shaped plate, or as a generally polygon shape 656 to cover a polygon shaped plate. It will be understood that the shapes shown in FIG. 34 are merely examples, and that the general principles of the present disclosure of providing removably securable plate cover assemblies can be applied to a wide variety of shaped and sized plates.

Embodiments of the present disclosure provide a dynamic and flexible approach to selectively covering dinnerware, such as plates. The plate cover assemblies of the present disclosure provide many ways to cover at least a border portion of a plate, with such coverings offering protection for the border of the plate, as well as the opportunity to provide decorations and/or operational information on the cover. A wide variety of fastener mechanisms can be employed to removably secure the plate cover assemblies to the plate. In this way, ordinary dinner plates can be used for dramatic effect or informational goals with the particular message being changed simply by switching covers or switching inserts. Accordingly, instead of owning several sets of plates, a homeowner or restaurant can use a single set of plates which are customizable via the plate cover assemblies of the present disclosure.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this present disclosure be limited only by the claims and the equivalents thereof.

What is claimed is:

1. A plate cover assembly comprising:

a first ring and a second ring, with each respective first and second ring including a generally annular body portion and an outer edge portion extending radially outward from the body portion, the outer edge portion configured to at least partially receive an outer edge of a plate, wherein the outer edge portion of each of the respective first and second rings include a first segment and a second segment located on an opposite side of the respective first and second rings from the first segment, wherein the body portion of the first ring includes at least one hole;

at least one dynamic surface feature having an anchor portion and an upper portion, wherein the at least one hole of the body portion of the first ring is configured to removably receive and secure the anchor portion such that the upper portion protrudes from, and is exposed on, a surface of the body portion of the first ring, and wherein the at least one dynamic surface feature includes circuitry and a power source; and a living hinge joining a first segment of the outer edge portion of the first ring to a first segment of the outer edge portion of the second ring, wherein the first ring, the second ring, and the living hinge are molded as a single, unitary piece, and wherein the plate cover assembly is convertible, via pivotal movement about the living hinge, between:

an open position in which the second segment of the first ring is rotated away from the second segment of the second ring to define an open space between the first and second rings sized to receive a plate; and a closed position in which the second segment of the first ring is releasably secured relative to the second segment of the second ring to form a complete ring defining a generally annular shape, wherein the respective first and second ring extend in substantially the same plane in the closed position but extend in different planes in the open position, and wherein the complete ring defines a central hole to expose a central region of a plate and the complete ring generally covers an outer border portion of the plate.

2. The plate cover assembly of claim 1, wherein, in the closed position, the first ring and the second ring are non-rotatable relative to each other.

3. The plate cover assembly of claim 1, wherein the second segment of the first ring includes a first engagement portion and the second segment of the second ring includes a second engagement portion, wherein, in the closed position, the second segment of the first ring is releasably secured to the second segment of the second ring via interaction of the respective first and second engagement portions, thereby sandwiching a portion of the plate between the first and second rings.

4. The plate cover assembly of claim 3, comprising at least one of:

the first engagement portion including at least one of a projection element and a recess element and the second engagement portion including the other respective one of the projection element and the recess element;

the first engagement portion including at least one of a pin element and a hole element and the second engagement portion including the other respective one of the pin element and the hole element;

the first engagement portion including at least one of a hook element and a loop element and the second engagement portion including the other respective one of the hook element and the loop element;

the first engagement portion including at least one of a flap element and a pin element and the second engagement portion including the other respective one of the flap element and the pin element; or the first engagement portion including at least one of a tongue element and a groove element and the second engagement portion including the other respective one of the tongue element and the groove element.

5. The plate cover assembly of claim 1, wherein the upper portion of the at least one dynamic surface feature provides audible sounds.

6. The plate cover assembly of claim 5, wherein the audible sounds includes at least one of music and a spoken message.

7. The plate cover assembly of claim 1, wherein the upper portion of the at least one dynamic surface feature provides illumination.

8. The plate cover assembly of claim 1, wherein the upper portion of the at least one dynamic surface feature provides both illumination and audible sounds.

9. The plate cover assembly of claim 1, wherein the at least one dynamic surface feature comprises a plurality of dynamic surface features arranged in an annular configuration on the body portion.

10. A plate cover assembly comprising:

a first ring and a second ring, with each respective first and second ring including a generally annular body portion and an outer edge portion extending radially outward from the body portion, the outer edge portion configured to at least partially receive an outer edge of a plate, wherein the outer edge portion of each of the respective first and second rings include a first segment and a second segment located on an opposite side of the respective first and second rings from the first segment, wherein the body portion of the first ring includes at least one hole;

at least one surface feature having an upper portion protruding from, and exposed on, a surface of the body portion and the at least one surface feature including an anchor portion, wherein the at least one hole of the body portion of the first ring removably receives the anchor portion, and wherein the at least one surface feature includes an electrically active element providing at least one of illumination and audible sounds; and a living hinge joining a first segment of the outer edge portion of the first ring to a first segment of the outer edge portion of the second ring, wherein the first ring, the second ring, and the living hinge are molded as a single, unitary piece, wherein the plate cover assembly is convertible, via pivotal movement about the living hinge, between:

an open position in which the second segment of the first ring is rotated away from the second segment of the second ring to define an open space between the first and second rings sized to receive a plate; and a closed position in which the second segment of the first ring is releasably secured relative to the second segment of the second ring to form a complete ring defining a generally annular shape, wherein the respective first and second ring extend in substantially the same plane in the closed position but extend in different planes in the open position, and wherein the complete ring defines a central hole to expose a central region of a plate and the complete ring generally covers an outer border portion of the plate.

11. The plate cover assembly of claim 10, wherein the body portion of the first ring includes at least one decorative element.

12. The plate cover assembly of claim 10, wherein the at least one surface feature includes circuitry and a power source.

13. The plate cover assembly of claim 10, wherein the at least one surface feature comprises a plurality of surface features arranged in an annular configuration on the body portion of the first ring, and wherein the at least one hole comprises a plurality of holes.

14. The plate cover assembly of claim 10, wherein the second segment of the first ring includes a first engagement portion and the second segment of the second ring includes a second engagement portion, wherein, in the closed position, the second segment of the first ring is releasably secured to the second segment of the second ring via interaction of the respective first and second engagement portions, thereby sandwiching a portion of the plate between the first and second rings.

15. The plate cover assembly of claim 14, comprising at least one of:

the first engagement portion including at least one of a projection element and a recess element and the second engagement portion including the other respective one of the projection element and the recess element;

the first engagement portion including at least one of a pin element and a hole element and the second engagement portion including the other respective one of the pin element and the hole element;

the first engagement portion including at least one of a hook element and a loop element and the second engagement portion including the other respective one of the hook element and the loop element;

the first engagement portion including at least one of a flap element and a pin element and the second engagement portion including the other respective one of the flap element and the pin element; or the first engagement portion including at least one of a tongue element and a groove element and the second engagement portion including the other respective one of the tongue element and the groove element.

* * * * *